United States Patent [19]

Nagano et al.

[11] 3,968,020

[45] July 6, 1976

[54] APPARATUS FOR SURFACE TREATING METAL MEMBERS

[75] Inventors: Toshihiro Nagano; Masashi Ikegaya; Tadao Maruyama; Fumio Shigeta; Yoshio Sano, all of Shizuoka, Japan

[73] Assignee: Riken Keikinzoku Kogyo Kabushiki Kaisha, Shizuoka, Japan

[22] Filed: Sept. 17, 1974

[21] Appl. No.: 506,726

[30] Foreign Application Priority Data

Sept. 29, 1973 Japan ..... 48-110044
Dec. 5, 1973 Japan ..... 48-137510

[52] U.S. Cl. ..... 204/203; 118/425; 118/503; 118/DIG. 12; 134/77; 134/134; 214/1 BB; 214/91 R

[51] Int. Cl.[2] ..... C25D 17/06

[58] Field of Search ..... 118/425, 423, DIG. 10, 118/DIG. 11, DIG. 12; 214/1 BB, 1 BY, 1 B, 89, 91 R; 266/4 A; 134/134, 76, 77; 294/104; 204/202, 203, 198

[56] References Cited

UNITED STATES PATENTS

| | | | |
|---|---|---|---|
| 155,711 | 10/1874 | Comey | 294/104 X |
| 856,996 | 6/1907 | Custer et al. | 118/DIG. 12 |
| 1,918,136 | 7/1933 | Rosenberg | 266/4 A |
| 2,048,938 | 7/1936 | Larson et al. | 118/425 UX |
| 2,922,340 | 1/1960 | Wilkie | 294/104 X |
| 2,979,181 | 4/1961 | Abbey | 214/89 X |
| 3,120,046 | 2/1964 | Olsen | 294/104 X |
| 3,262,420 | 7/1966 | Bossi et al. | 118/423 X |

*Primary Examiner*—Morris Kaplan
*Attorney, Agent, or Firm*—Finnegan, Henderson, Farabow & Garrett

[57] ABSTRACT

Surface treating apparatus comprising treating bath means; a carrier bar having devices for vertically suspending workpieces; lifting means provided at the sides of the bath means for vertically conveying the carrier bar and dipping said workpieces into and out of said bath means, the lifting means also including means for conveying the carrier bar in a substantially horizontal direction; loading means rotatable between a horizontal and a vertical position and adapted to removably receive the carrier bar having workpieces attached in the horizontal position for loading the carrier bar onto the lifting means in the vertical position; unloading means rotatable between a horizontal and a vertical position and adapted to receive the carrier bar supporting finished workpieces in the vertical position, the workpieces being released from the carrier bar when the unloading means is in a horizontal position; and returning conveyor means between the loading and unloading means so that the carrier bar moves from the loading means, through said lifting means to the unloading means and returning means, and back to the loading means.

12 Claims, 19 Drawing Figures

APPARATUS FOR SURFACE TREATING METAL MEMBERS

The present invention relates to an apparatus for surface treating metal members, such as extruded aluminum members, and more particularly to an apparatus for providing uniform coatings on such metal members.

Recently, extruded aluminum members have been widely used in buildings and many types of vehicles since they are easy to manufacture, less expensive and light in weight. These extruded members are normally used with protective and decorative coatings which are provided thereon by surface treatment. For surface treating such members, a dip-coating process has been widely used from the viewpoint of safety and economy. The process utilizes a water-soluble thermosetting resin to form a coating on the member. It is of course required that the process can provide a uniform coating of a desired thickness and, when required, a uniformly colored coating on the member. It has theoretically been recognized that a desired uniform coating can be formed by vertically suspending an elongated member, dipping it into a coating bath in which the density and viscosity of the coating material are suitably controlled, and by lifting it from the bath under a controlled speed. However, in conventional processes, such elongated members have been horizontally suspended due to the lack of a simply constructed and positive means for suspending elongated members vertically and conveying means for transporting a large number of suspended members through the coating station.

Thus, in accordance with a conventional process, pre-treated elongated members such as extend aluminum members are suspended in such a manner that they extended horizontally with one end of each member slightly lower than the other end dipped into a bath of coating material. In the known process, there is a tendency that, when the members are lifted from the bath, molten coating material or solution of the coating material deposited on the surface of each member is accumulated along the lower side edges of the member to form a coating layer of an excessive thickness. Further, in the known process in which the members are suspended horizontally, there is only small distance between the uppermost portion and the lowermost portion of each member so that it is practically impossible to control the thickness of the coating by controlling the lifting speed and the density and viscosity of the coating bath. Particularly, it is impossible to provide a coating of a substantial thickness by this known process.

In a conventional dip-coating apparatus, one or more movable straddling cranes are provided to run along rails at the opposite sides of a coating bath. One or more frames are suspended from each of the cranes for carrying elongated members to be coated. In the known dip-coating apparatus, the elongated members are secured to the frame or frames by means of bolts. However, it is apparently impractical to employ such a securing means. Further, when one of the cranes is in a processing position, a succeeding crane must be in a ready position so that the working capacity of one crane is affected by the movement of another crane. More particularly, when one crane is in a pre-treating station and the pre-treatment is completed, it is ready to move to the next station, for example a coating station. However, if there is another crane in the coating station and the work at that station is not completed, the crane which is in the pre-treating station is not allowed to be moved into the coating station.

The present invention has an object to provide an apparatus for providing a uniform coating of a desired thickness on an elongated member.

Another object of the present invention is to provide a coating apparatus which includes means for vertically suspending elongated members that is simple in design and construction.

A further object of the present invention is to provide an apparatus for sequentially treating a substantial number of elongated members.

The above and other objects and features of the present invention will become apparent from the following description of a preferred embodiment taking reference to the accompanying drawings, in which.

Figure 1:
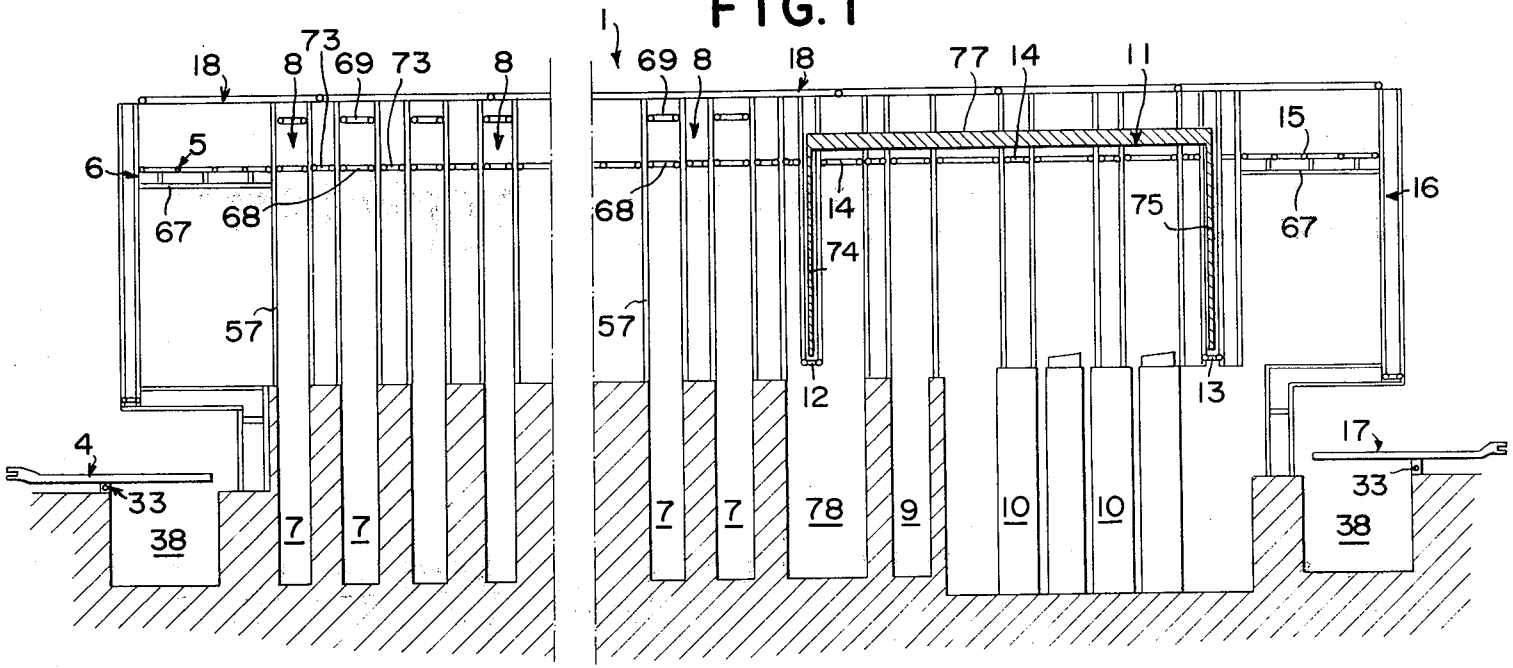
FIG. 1 is a vertical sectional view of a surface treating apparatus in accordance with one embodiment of the present invention and shows the general flow of workpieces or members to be treated in the apparatus.
Figure 8:
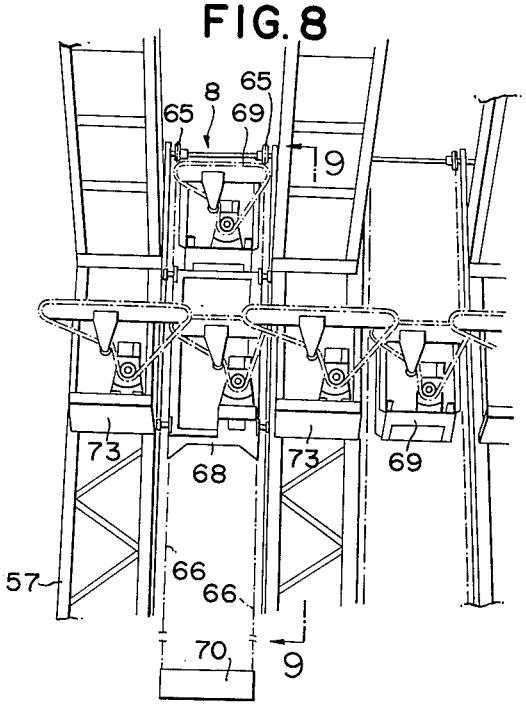
Figure 7:
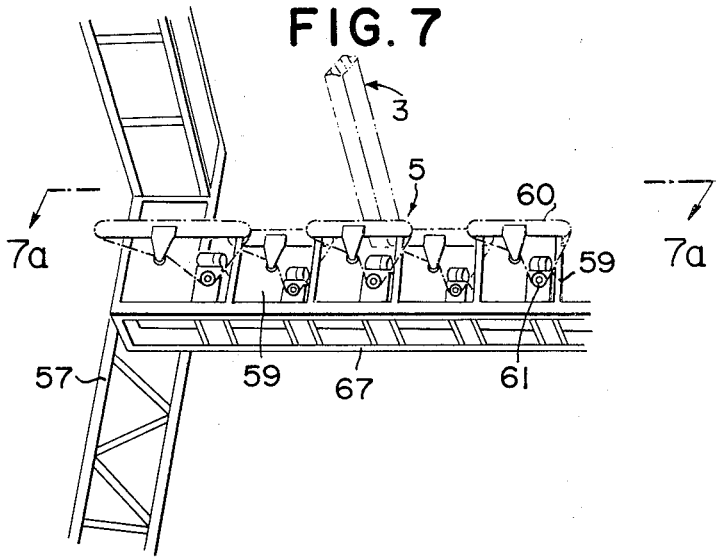
FIG. 7 is a perspective view showing a horizontal conveying mechanism.
Figure 7A:
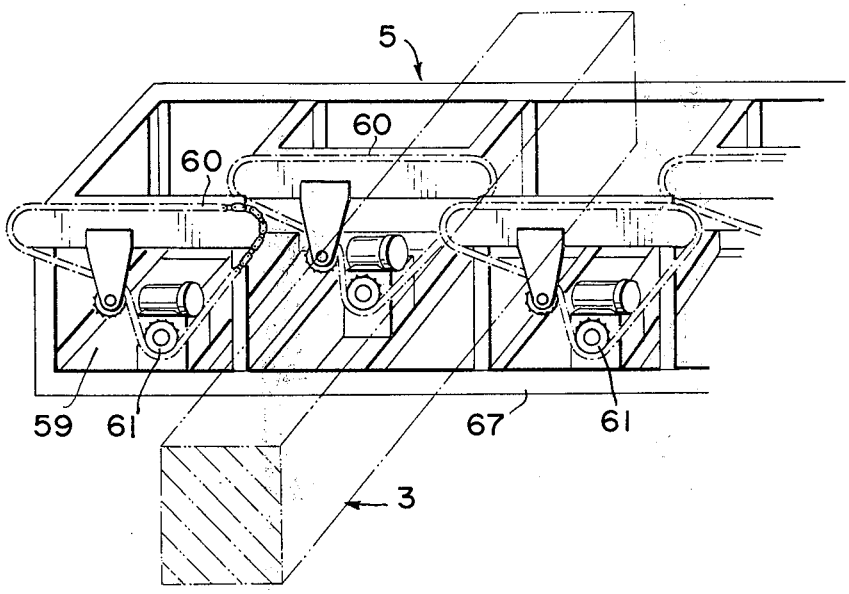
Figure 9:
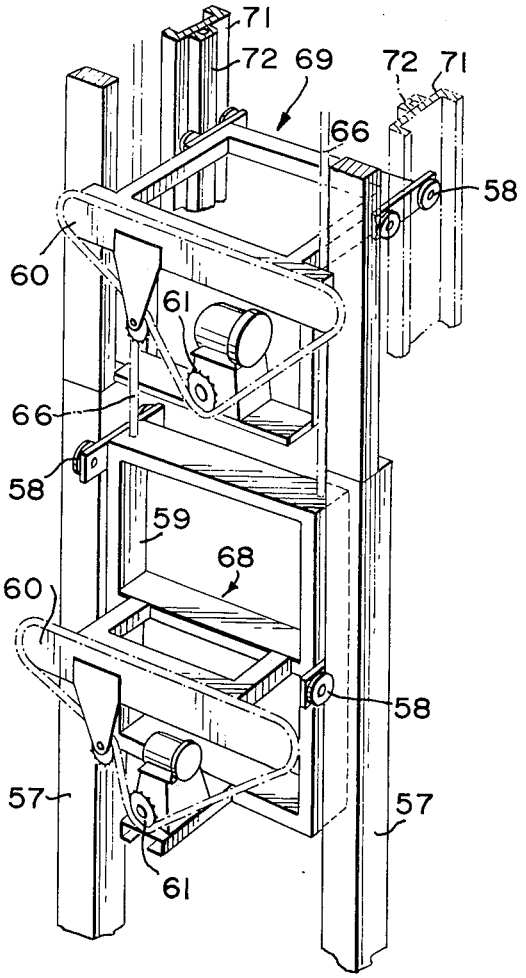
Figure 9A:
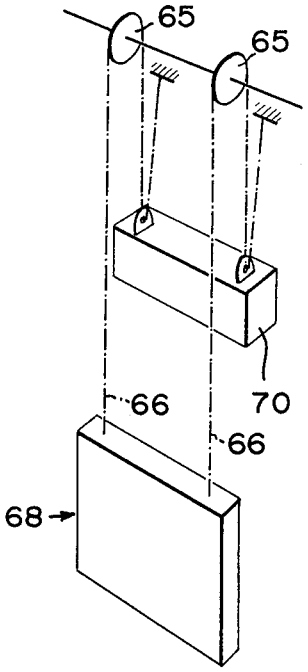
Figure 11:
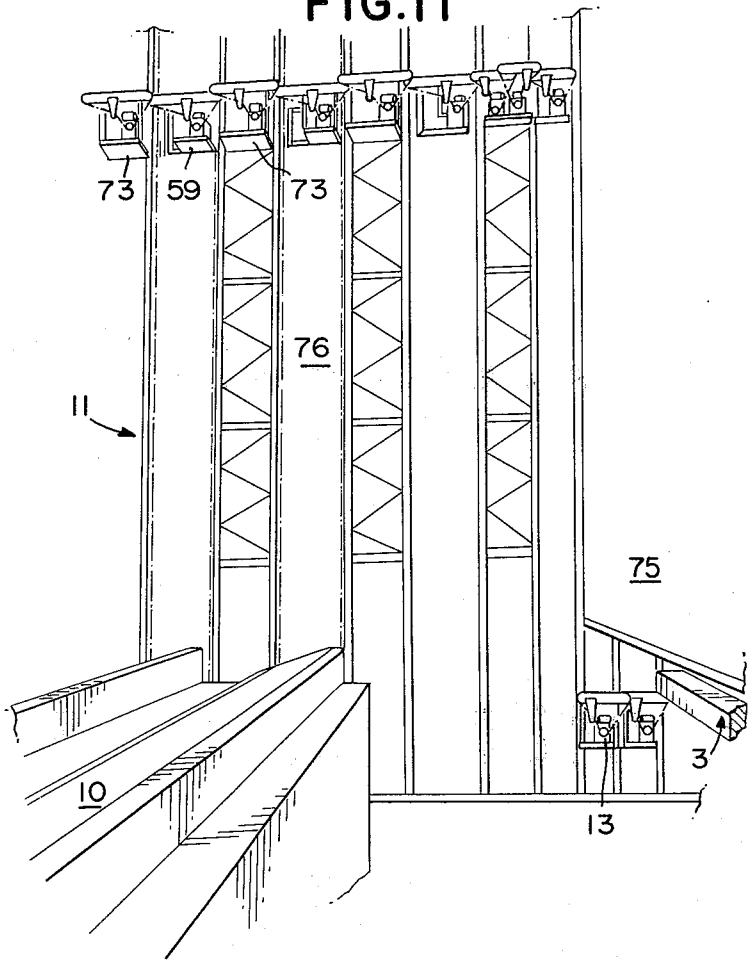
Figure 10:
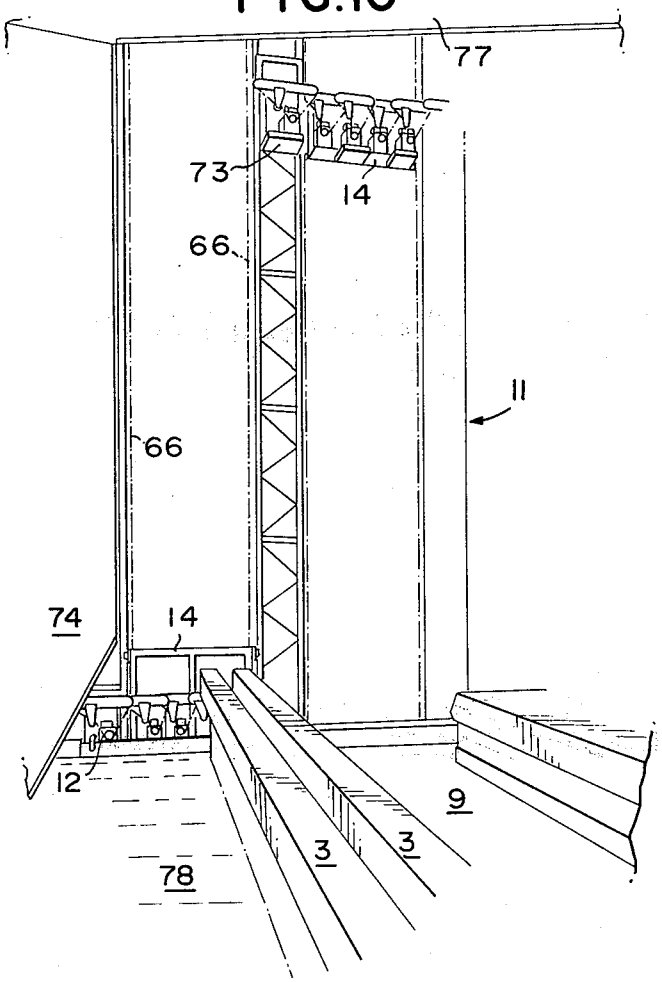
Figure 12:
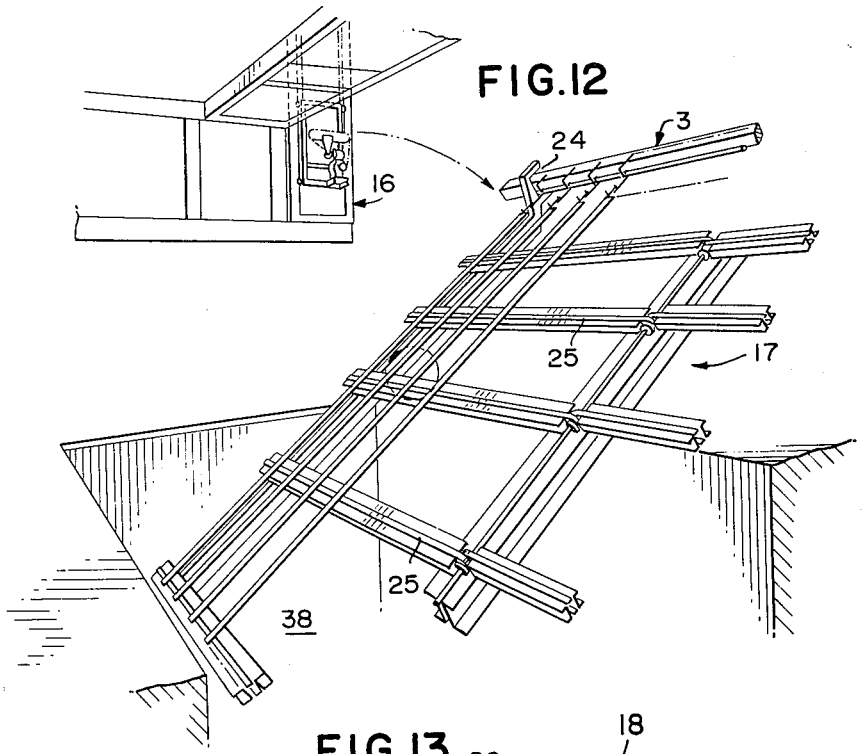
Figure 13:
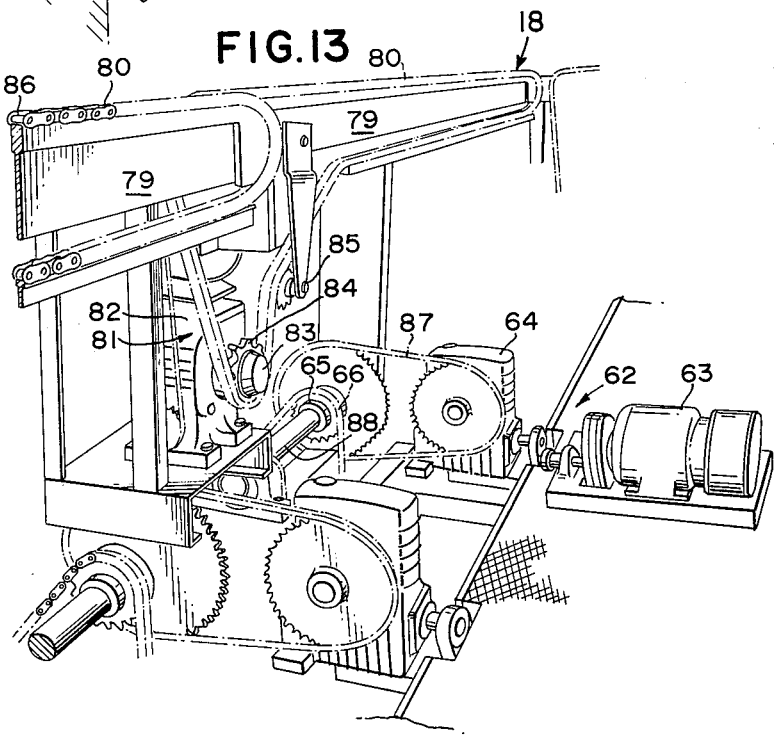
Figure 14:
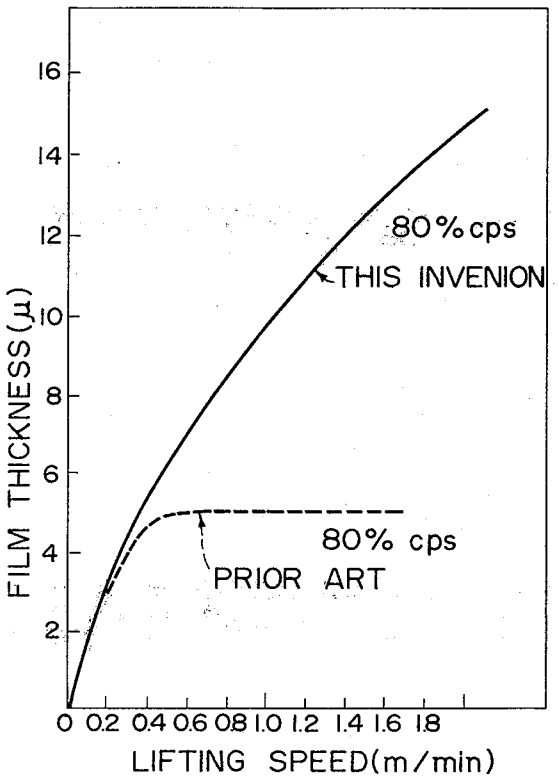

FIG. 7*a* is a view taken along line 7*a*—7*a* of FIG. 7;

FIG. 8 is a perspective view showing hoisting means of the apparatus of FIG. 1;

FIG. 9 is a view taken along line 9—9 of FIG. 8 showing the hoisting means in detail;

FIG. 9*a* is a perspective view showing a balancer weight of the hoisting means;

FIG. 10 is a perspective view of the carrier bars in a heating chamber of the apparatus of FIG. 1;

FIG. 11 is a perspective view showing a carrier bar which is being moved out of the heating chamber of the apparatus of FIG. 1;

FIG. 12 is a perspective view of the erectable frame mechanism provided at the unloading part of the apparatus;

FIG. 13 is a perspective view of outlet conveying means and hoist actuating means;

FIGS. 14 through 17 are diagrams showing the relationship between the member lifting speed and the coating thickness.

Referring now to the drawings, and as best seen in FIG. 1, one side of the surface treating apparatus is shown embodying the features of the present invention (the other side thereof is symmetrically arranged). The apparatus 1 comprises an erectable loading frame 4 having an end for receiving a carrier bar or hanger 3 which is adapted to carry a plurality of elongated members or workpieces 2 to be treated (FIG. 6), first lifting means 6 adapted to receive the carrier bar 3 having the elongated workpieces 2 suspended thereunder from the loading frame 4 and transporting the bar 3 vertically upwardly toward horizontal conveying means 5 which is provided above the loading frame 4, second lifting means 8 for receiving the carrier bar 3 conveyed by the horizontal conveying means 5 and transporting it vertically into and out of a treating bath 7 which is provided beneath the lifting means 8, enclosure means 11 for defining an insulated heating chamber above coating baths 9 and baking furnaces 10, conveying means 12 for conveying the bar 3 into said heating chamber, conveying means 13 for conveying the bar 3 carrying coated workpieces out of the chamber, conveying means 14 for moving the bar 3 vertically and also horizontally in the heating chamber, further conveying means 15 for horizontally transporting the bar 3 from the conveying means 13, third lifting means 16 for receiving the bar 3 from the conveying means 13 and transporting it vertically downwardly, and an unloading frame 17 movable between a vertical position and a horizontal position and having an end for receiving the carrier bar 3 at its vertical position from the third lifting means 16. The frame 17 is then moved to its horizontal position where the treated workpieces are removed from the carrier bar. Returning conveyor means 18 is provided at the upper portion of the apparatus and extends horizontally throughout the length of the apparatus. The unloading frame 17 carrying a carrier bar 3 from which workpieces are removed as described above is again moved to its vertical position where the bar 3 is again picked up by the third lifting means 16 and moved upwardly into the returning conveyor means 18 by which it is returned to the loading portion of the apparatus.

Figure 2:
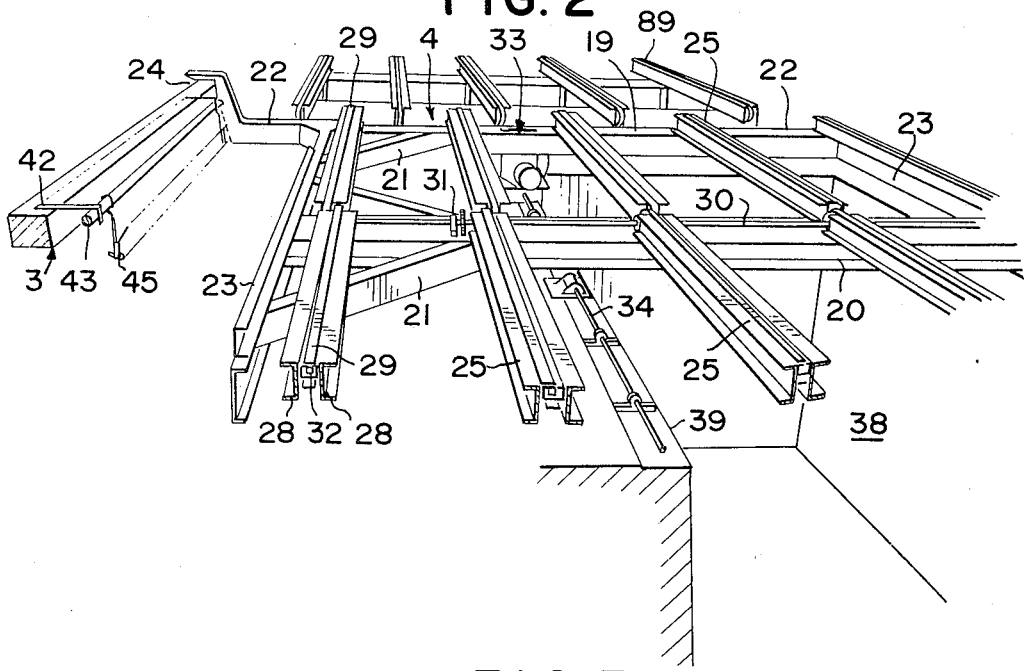
FIG. 2 is a fragmentary perspective view of an erectable frame mechanism provided at the loading part of the apparatus of FIG. 1.
Figure 3:
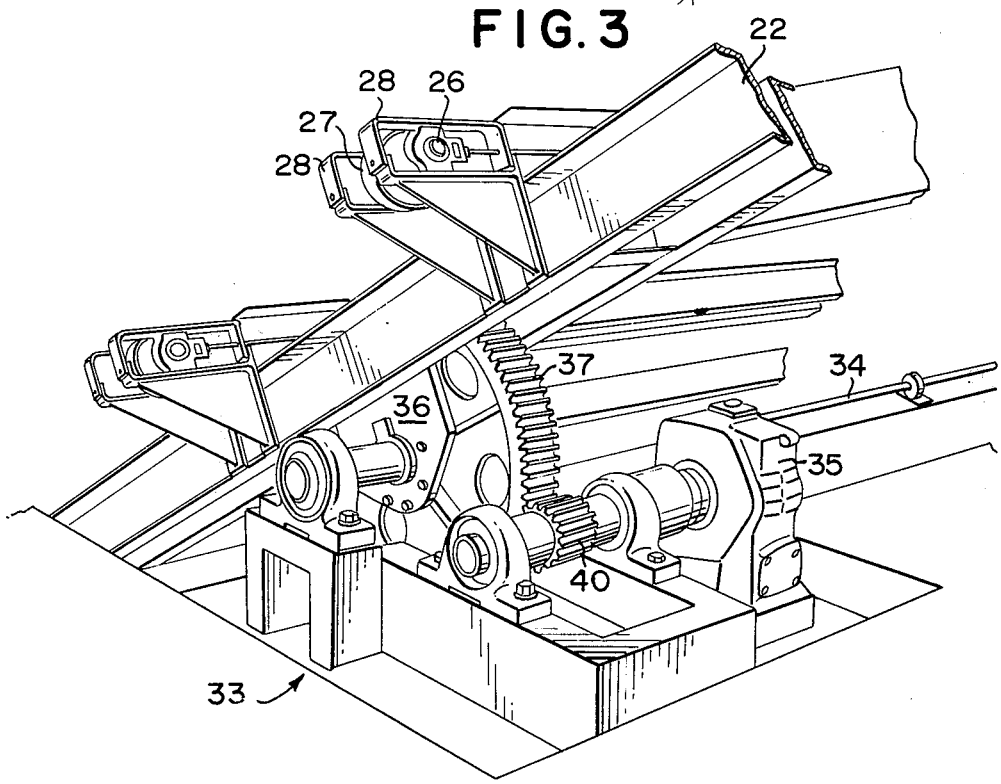
FIG. 3 is a perspective view of an operating device for the erectable frame mechanism shown in FIG. 2.
Figure 6:
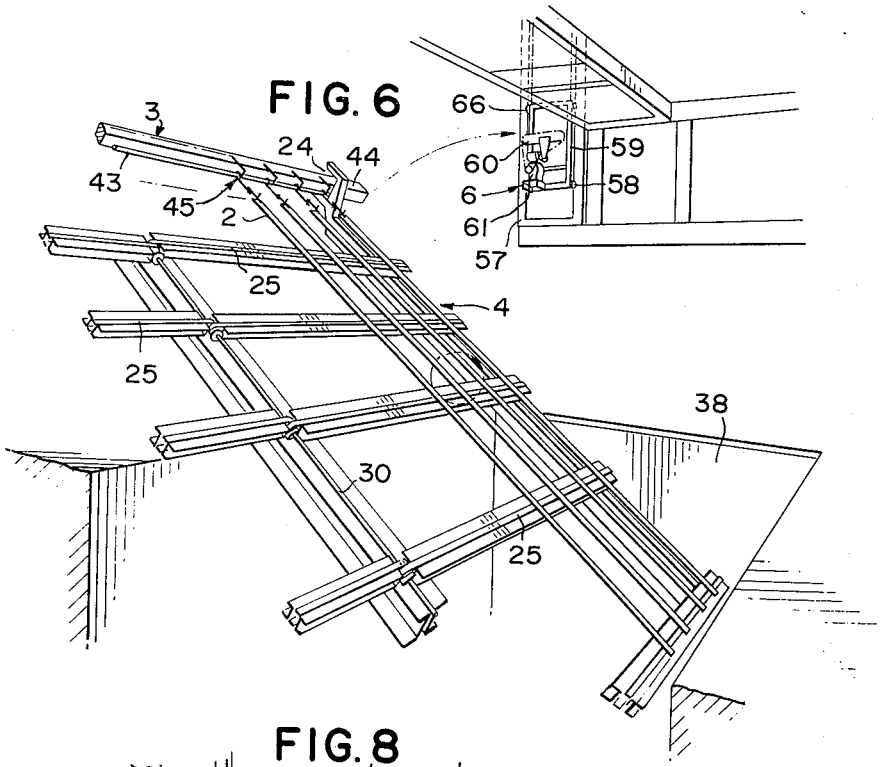
FIG. 6 is a perspective view showing the erectable frame mechanism in partially erected position.

Reference is now made to FIGS. 2 and 3. In FIG. 2, there is shown the erectable loading frame 4 in horizontal position. Since the frame 4 is symmetrical with respect to the longitudinal center line thereof, its structure will be described only with respect to one side thereof. The frame 4 includes a rectangular main frame structure 19 made of interconnected extrusion members, a longitudinally extending center spar 20 and reinforcement members 21. The main frame structure 19 has longitudinal members 22 each having one end projecting beyond a transverse member 23. The longitudinal member 22 is provided at the projecting end with an open top groove 24 for receiving the carrier bar 3 with workpieces suspended therefrom (FIG. 6). Between the longitudinal member 22 and the center spar 20 there are disposed a plurality of transversely extending belt conveyors 25 each of which comprises a pair of opposed channel section members 28, supporting pulleys 27 at the opposite ends thereof, and an endless belt 29 passing between and around the pulleys 27. One of the pulleys 27 has a shaft 30 having one end secured thereto and the other end connected with a motor 31 so that the belt 29 is driven by the motor 31. A suitable number of rollers 32 may be provided beneath the belt 29 for supporting the load on the belt. The frame 4 is pivotably mounted on the base at about the center of the longitudinal member 22. Means 33 is provided for moving the frame 4 between the horizontal position and the vertical position in which the grooved ends 24 of the longitudinal members 22 are directed upwardly. The means 33 includes a drive shaft 34 which has one end connected with a motor (not shown) and the other end connected with a speed reduction device 35 having a gear 40 meshing with a gear 37 secured to a bracket 36 which is provided on the longitudinal member 22. Thus, by rotating the drive shaft by the motor in either direction, the frame 4 is turned about its pivot axis from the horizontal position to the vertical position or vice versa. The base is provided with a recess 38 for accommodating the lower portion of the frame 4 when it is in the vertical position and the pivot axis of the frame 4 is disposed near the upper corner 39 of the recess 38.

Figure 4:
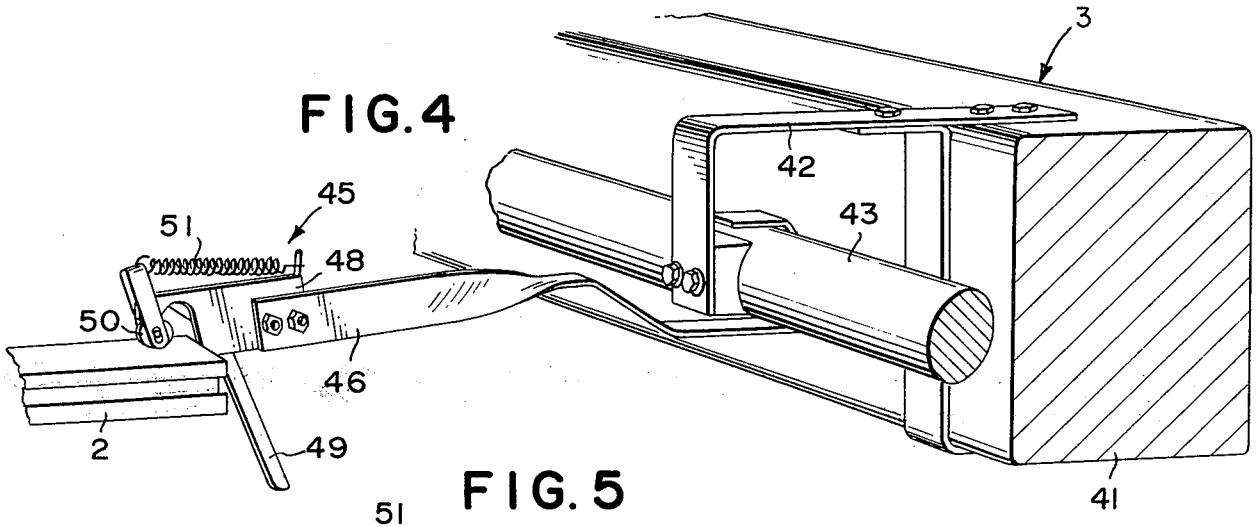
FIG. 4 is a fragmentary perspective view showing a part of a carrier bar for suspending members to be treated.

As best seen in FIG. 4, the carrier bar 3 for suspending elongated members or workpieces 2 comprises a main bar body 41 which is preferably of a rectangular cross-section and made of an electrically non-conductive material, and an electrically conductive rod 43 of a circular cross-section which is spaced apart from the main bar body 41 and connected thereto by connecting members 42. The conductive rod 43 is connected with an electrically conductive plate 44 mounted on the opposite end surfaces of the main bar body 41 as shown in FIG. 6.

Figure 5:
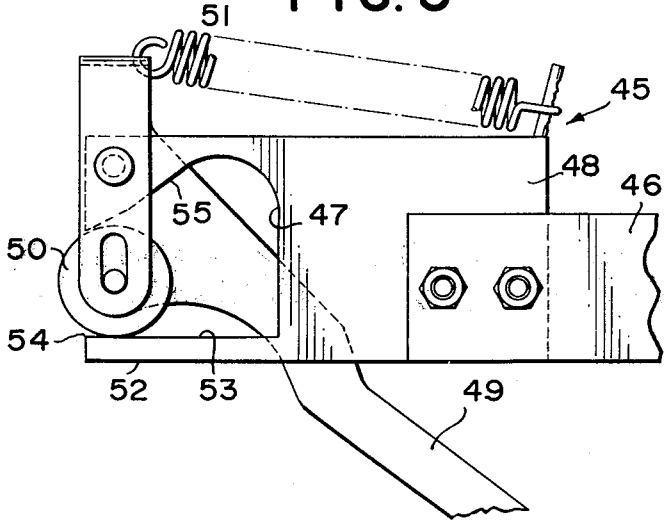
FIG. 5 is a fragmentary side elevational view showing an end portion of the erectable frame mechanism shown in FIG. 2.

Referring to FIGS. 4, 5 and 6, a suitable number of suspending devices 45 engage with the rod 43 for suspending workpieces 2. The device 45 comprises a suspending member 46 having one end engageable with the rod 43, and secured to a main plate member 48 at the other end. The main plate member 48 is provided with a cutout 47 and has a lever 49 pivotably mounted on the main plate member 48. The lever 49 carries a roller 50 which is positioned in the cutout 47. A spring 51 is connected to the lever 49 for biasing it in such a direction that the roller 50 is forced toward an end opening 54 of the cutout 47. The cutout 47 is of such a shape that it has a straight portion 53 parallel with the bottom edge 52 of the member 48 and a slanted portion 55 extending from the end opening 54. The opening 54 is slightly smaller than the diameter of the roller 50 so that the roller 50 is prevented from being disengaged from the cutout 47. In loading the workpiece, the lever 49 is actuated so as to move the roller 50 along the slanted portion 55 so that a space is provided between the roller 50 and the straight portion 53. Then, one end of the workpiece 2 is inserted into the cutout 47 and the lever 49 is released. Thus, the workpiece is frictionally gripped at the cutout 47 by the roller 50 and the straight portion 53. When the workpiece is vertically suspended, the weight of the workpiece 2 and the frictional force between the roller 50 and the workpiece 2 cause the roller 50 to move toward the opening 54 of the cutout 47 resulting in an increased gripping force. The members 46 and 48 and the roller 50 are made of electrically conductive materials. Preferably, the member 46 is made of copper and the member 48 and the roller 50 of copper alloy, such as copper-titanum alloy or copper-beryllium alloy. These copper alloys are satisfactory for the use in the apparatus of the present invention in respect of conductivity, resistance to chemical agents and mechanical strength.

As shown in FIG. 6, the first lifting means 6 serves to receive the carrier bar 3 from the frame 4 when it is in the vertical position and to transport it vertically upwardly. Further, the means 6 also serves to receive an empty carrier bar 3 from the returning conveyor means 18 and to convey it downwardly into the groove 24 of the frame 4. The lifting means 6 comprises a vertical frame structure 57, and a movable frame assembly 59 having rollers 58 for sliding vertical movement along the frame structure 57. The movable frame assembly 59 is provided with a conveyor assembly 60 and a power source 61 therefor. Means similar to those shown in FIGS. 8, 9*a* and 13 can be provided comprising means 62 for effecting vertical movement of the frame assembly 59, including a motor 63 mounted on the vertical frame structure 57 at the upper portion thereof for driving a sprocket 65 through a speed reduction device 64, and a chain 66 engaging the sprocket 65 and having one end secrured to the frame assembly 59 and the other end with a weight 70. Thus, as the motor 63 is operated in either direction, the sprocket 65 is driven so that the chain 66 and thus the movable frame assembly 59 are moved vertically upwardly or downwardly. The loading frame 4 is moved to the vertical position with a loaded carrier bar 3 thereon and to such a position that the carrier bar 3 is rested onto the movable frame assembly 59 of the first lifting means 6 at the extreme lower position. Then, the frame assembly 59 is moved upwardly from the loading frame 4 for transporting the bar 3 vertically upwardly. When the frame assembly 59 reaches a level equal to the horizontal conveying means 5, it is stopped and the chain conveyor 60 is started to operate so as to transfer the carrier bar 3 into the conveyor means 5.

As seen in FIGS. 7 and 7*a*, the horizontal conveyor means 5 includes a horizontal framework 67 extending perpendicularly to the vertical frame structure 57 and supporting frame assemblies 59 fixed to the framework 67. Each assembly 59 has a motor 61 and a chain conveyor 60 driven by the motor 61. The horizontal conveyor means 5 includes a plurality of frame assemblies 59 arranged horizontally in series and fixed to the framework 67. An electrical control means (not shown) is provided for preventing the succeeding conveyor 60 from being operated when a carrier bar 3 is on the preceding conveyor 60 so as to prevent the succeeding carrier bar 3 from coming into collision against the preceding carrier bar 3.

The second lifting means 8 serves to receive a carrier bar 3 from the horizontal conveyor means 5 and transports it vertically downwardly. Referring to FIGS. 8, 9 and 9*a*, the second lifting means 8 comprises upper and lower vertically movable cranes 68 and 69. The lower crane 68 is constructed in the similar manner as the aforementioned first lifting means 6 and includes the frame assembly 59 having the motor 61 and the chain conveyor 60 driven by the motor 61. The frame assembly 59 has rollers 58 which run along the framework 57 for vertically moving the frame assembly 59. A motor is mounted on the framework 57 at the upper end thereof and has a sprocket 65 which engages with the chain 66 secured at one end with the framework and having the weight 70 at the other end, whereby the frame assembly 59 is vertically moved as the motor is operated. The upper crane 69 is similar in construction as the lower crane 68 except that it is simply supported by the upper end of the frame assembly 59 of the lower crane 68 but is not driven through the chain 66. Upper crane 69 has rollers 58 adapted to run along guide members 72 secured to the web 71 of the vertical framework 57. Downward movement of the upper crane 69 is limited by suitable stopper means (not shown) so that, when the lower crane 68 is moved downwardly with the loaded carrier bar 3 thereon to dip the workpieces on the carrier bar 3 into a bath 7 (FIG. 1), the upper crane 69 is held at the level of the conveying means 5. Thus, if a succeeding carrier bar 3 is fed when the lower crane 68 is in the lower dipping position, the conveyor of the upper crane 69 serves to transfer the bar to the next conveying means 73. Thus, a plurality of second lifting means 8 may be provided as shown in FIGS. 1 and 8 with intermediate conveying means 73 between each two adjacent lifting means 8. The conveying means 73 is basically similar to the frame assembly 59 for use in the conveying means 5 but includes only one frame assembly and chain conveyor.

Referring now to FIGS. 10 and 11, the enclosure means 11 for defining a dustfree heating chamber comprises front and rear walls 74 and 75, respectively, opposing side walls 76 and a ceiling wall 77, and is positioned above a washing bath 78, a coating bath 9 and baking vessels 10 so as to cover the upper portions thereof. The conveyor means 12 is fixedly provided at the lower end of the front wall 74 and serves to receive a carrier bar 3 from the second lifting means 8. Conveyor means 12 then transports the carrier bar 3 to a vertically movable conveyor 14 in the chamber at the lower position of the conveyor 14. The conveyor 14 then transports the carrier bar 3 vertically upwardly and transfers the bar 3 to another conveyor 14 which carries the bar downwardly until the workpieces are dipped into the coating bath 9. After the coating process, the workpieces are lifted from the bath 9 by the conveyor 14. The vertically movable conveyor 14 is substantially identical in construction to the lower crane 68 in the second lifting means 8. The carrier bar 3 having coated workpieces is then transferred to the next vertical conveyor 14 by which it is moved downwardly until the workpieces suspended therefrom are placed in the baking vessel 10. The conveying means 13 is provided at the lower end of the rear wall 75 and serves to transport the carrier bar 3 having finished workpieces out of the chamber. The carrier bar 3 is then transferred to the horizontal conveying means 15 (FIG. 1) which may be of substantially identical construction to the horizontal conveying means 5. The third lifting means 16 (FIG. 1) may be substantially identical in construction to the first lifting means 6 and co-operates with the horizontal conveying means 15. Referring to FIG. 12, when the third lifting means 16 is lowered with the carrier bar 3 placed thereon, the unloading erectable frame 17 which is in the vertical position at this stage of operation receives the carrier bar 3 at the grooves 24 from the lifting means 16 and then turned to its horizontal position. At the horizontal position of the unloading erectable frame 17, the finished workpieces 2 are removed from the suspending devices 45 on the carrier bar 3 and the belt conveyor 25 serves to transport the workpieces to the next station. The unloading frame 17 having an empty carrier bar 3 is then moved to its vertical position where the empty carrier bar 3 is transferred to the third lifting means 16. Thereafter, the carrier bar 3 is transported upwardly and transferred from the lifting means 16 to the returning conveyor 18 by operating the chain conveyor 60 in the third lifting means 16.

Referring to FIG. 13, the returning conveyor 18 comprises a pair of chains 80 movable along the guide members 79 and chain operating means 81. The chain operating means comprises a motor (not shown) and a speed reduction device 82 which has an output shaft 83 provided with a sprocket 84 for engagement with the chain 80. A tensioning sprocket 85 is provided to stretch the chain 80. The chain 80 has linking pins 86 which are also adapted to ride on the upper edges of the guide rails 79 for ensuring guiding function. FIG. 13 further shows the means 62 which is employed to vertically transport a crane on which the carrier bar 3 rests. The empty carrier bar 3 transported by the returning conveyor 18 is returned to the loading frame 4 by the first lifting means 6.

In loading the workpiece to be treated, such workpieces 2 are disposed side by side on an inlet conveyor 89 as seen in FIG. 2. Then, the inlet conveyor 89 is operated so as to move the workpieces 2 toward the erectable loading frame 4 in the horizontal position. The conveyors 25 on the frame 4 may be actuated simultaneously so as to facilitate loading of the workpieces 2 on the loading frame 4. It is of course possible to load the workpieces directly on the loading frame 4.

Then, each of the workpieces is gripped by the suspending device 45 by simply actuating the lever 49 associated thereto. The actuating means 33 is then operated to move the loading frame 4 from the horizontal position to the vertical position so as to carry the carrier bar 3 on the frame 4 above the first lifting means 6 which is at the lower position at this stage of operation. Thereafter, the first lifting means 6 is moved upwardly until the carrier bar 3 reaches the level of the horizontal conveying means 5, and the chain conveyor 60 is then operated to transfer the carrier bar 3 to the horizontal conveying means 5. When there is an empty carrier bar 3 returned by the conveyor 18, the first lifting means 6 is further moved upwardly to receive the empty carrier bar. Then, the first lifting means 6 is moved downwardly until the empty carrier bar 3 is received by the loading frame 4 at its grooves 24. The loaded carrier bar 3 on the horizontal conveying means 5 is moved forward by the chain conveyor 60 until it is received by the second lifting means 8. A plurality of baths 7 are provided for performing pretreatment such as degreasing, washing, neutralizing, electrolysing, and a further washing, as well as anodizing. The second lifting means 8 includes a plurality of lifts which are disposed in pairs at the opposite sides of the baths for moving the carrier bars 3 downwardly until the workpieces 2 suspended therefrom are dipped into the associated baths. It is preferably to provide at least two baths for each treatment. For example, two degreasing baths may be provided. Then, when one of the baths is occupied by a carrier bar 3, a succeeding carrier bar 3 is allowed to pass through the bath by means of the upper crane 69 to the next degreasing bath and lowered into the second bath by means of the lifts associated thereto. The pretreated workpieces are then transported into the final washing bath 78 by the conveyor 12 and lifted by the conveying means 14.

It is important, in obtaining a uniform coating of a desired thickness at the coating process, to have precisely controlled composition and various conditions of the coating bath.

Table 1 shows preferable data for performing the coating process in the apparatus of the present invention.

Table 1

| | Type | Composition of Coating Material Good | Best | Preferred Treating Condition | Coating Standard |
|---|---|---|---|---|---|
| Transparent Coating | Room Temp. | Solids 15 – 40% | Solids 18 ± 2% | Specific weight: 0.95 ± 0.1 Surface Tension: 33 – 2dyne/cm Viscosity: 15 – 35cps | |
| | | Solvents 20 – 50% | Solvents 35 ± 5% | lifting speed: 0.3 – 2.0m/min atmospheric temperature: 20 – 40°C | 7 – 12 μ |
| | Raised Temp. | Solids 15 – 45% | Solids 20 ± 2% | Specific weight: 1.0 – 0.1 Viscosity: 15 – 35cps lifting speed: 0.3 – 2.0m/min | |
| | | Solvents 20 – 55% | Solvents 35 ± 5% | atmospheric temperature: 20 – 40°C | |
| Coloured Coating | Room Temp. | Solids 20 60% | Solids W 35 ± 2% B 20 ± 2% | Specific weight: W 1.2 ± 0.1 B 1.0 ± 0.1 | |
| | | Solvents 20 – 60% | Solvents 30 ± 5% | Viscosity: 15 – 35cps lifting speed: 0.3 – 2.0m/min atmospheric temperature: 20 – 40°C | |
| | | Pigments (PVC) | Pigments W 25 ± 2% B 5 ± 2% | | 15 – 30 μ |
| | Raised Temp. | Solids 20 – 60% | Solids W 40 ± 2% B 25 ± 2% | Specific weight: W 1.2 ± 0.1 B 1.0 ± 0.1 | |
| | | Solvents 20 – 60% | Solvents 25 ± 5% | Viscosity: 15 – 35cps lifting speed: 0.3 – 2.0m/min atmospheric temperature: 20 – 40°C | |
| | | Pigments (PVC) 3 – 30% | Pigments W 25 ± 2% B 5 ± 2% | | |

It is desirable to maintain the temperature of the coating material in the coating bath between 30°C and 70°C, preferably between 40°C and 50°C. In a coloured coating material, inorganic pigments such as titanate or lithopone for white, Indian red or mercantile for red, chromium oxide for green and carbon black for black.

In order to obtain a smooth and uniform coating, it is preferable to use ethylene-gylcol-monoethylether as the solvent because it is less affinitive to resin as compared with conventional solvents so that it is readily released from the coating.

EXAMPLE 1

Aluminum Alloy members (JIS 6063) were deoiled or degreased by dipping them into 8.0% NaOH solution of about 60°C temperature for about three minutes and thereafter washed. Then, the members were dipped under room temperature into 10% $HNO_3$ solution for twenty sedonds to neutralize NaOH on the members and thereafter washed. The degreased aluminum alloy members were dipped for five minutes into a warm solution of 50°C containing 500 ppm of di-methyl-ethanol-amine so as to form amber coloured bayerite films or coatings on the members. Then, steam was injected on the members to have the bayerite watings grown and also to produce boehmite coatings or films. The aforementioned pretreated aluminum alloy members were then subjected to dip coating process in two groups, in one of the groups the members being dipped into the coating bath with a slight inclination from the horizontal position as in the conventional process and in the other group with vertically suspended position in accordance with the present invention. The data for the coating process are given hereunder.

| | |
|---|---|
| (a) Composition of the coating Material | |
| acryl and melamine resin | 19.4% |
| buthylen-glycol-mono-ethyl-ether | 17.8% |
| ethylen-glycol-mono-ethyl-ether | 11.1% |
| water and others | 51.7% |
| (b) Physical Characteristics of Coating Material | |
| specifi weight | 1.0 |
| surface tension | 33.4 dyne/cm |
| viscosity | 19.0 cps |
| temperature | 40°C |
| (c) Process Condition | |
| dipping time | 30 sec. |
| lifting speed | 0.5, 0.7, 0.9, 1.2 m/min. |
| angle to the bath surface | 1st group 30°<br>2nd group 90° |
| baking | 40°C, 1 min to 180°C, 30 min. |

The above coating material was used with the addition of 80% of water. The results are shown in Table 2 and FIG. 14. As shown therein, it is possible to vary the thickness of the coating in accordance with the lifting speed so that it is possible to obtain a desired coating through adjustment of the lifting speed.

Table 2

| Lifting speed / Type of process / Distance | 0.5m/min | | 0.7m/min | | 0.9m/min | | 1.2m/min | |
|---|---|---|---|---|---|---|---|---|
| | Invention | Prior art | Invention | Prior art | Invention | Prior art | Invention | Prior art |
| 5 cm | 5.3μ | 5.0μ | 6.7μ | 4.8μ | 6.2μ | 4.6μ | 6.7μ | 4.4μ |
| 10 | 6.5 | 4.5 | 8.4 | 4.3 | 8.1 | 4.1 | 8.1 | 4.8 |
| 15 | 6.5 | 4.3 | 8.3 | 4.2 | 10.4 | 4.2 | 10.0 | 4.2 |
| 20 | 6.2 | 4.5 | 8.4 | 4.7 | 10.1 | 4.7 | 11.7 | 4.3 |
| 30 | 6.4 | 4.5 | 8.0 | 4.1 | 9.4 | 4.0 | 11.8 | 4.4 |
| 40 | 6.3 | 4.8 | 8.0 | 4.1 | 9.6 | 5.1 | 11.3 | 4.3 |
| 50 | 6.4 | 4.3 | 7.6 | 4.5 | 9.7 | 4.5 | 11.4 | 4.8 |
| 80 | 5.9 | 4.2 | 8.1 | 4.1 | 9.2 | 4.5 | 11.8 | 4.0 |
| 100 | 5.8 | 5.2 | 7.8 | 4.9 | 9.8 | 5.0 | 11.4 | 4.1 |
| 150 | 6.0 | 5.0 | 7.6 | 5.0 | 9.5 | 4.4 | 11.5 | 4.3 |
| 200 | 6.2 | 4.0 | 7.7 | 4.2 | 9.7 | 4.4 | 11.4 | 4.5 |
| 250 | 6.0 | 4.2 | 8.0 | 4.3 | 9.4 | 4.3 | 11.1 | 4.4 |
| 300 | 5.9 | 4.8 | 7.9 | 4.1 | 9.8 | 4.3 | 11.1 | 4.8 |
| 350 | 5.9 | 4.5 | 7.9 | 4.1 | 9.4 | 4.7 | 11.5 | 4.0 |
| 400 | 6.1 | 4.4 | 7.6 | 4.7 | 9.3 | 4.6 | 11.4 | 4.5 |
| 450 | 5.9 | 4.7 | 7.9 | 4.6 | 8.7 | 4.8 | 11.0 | 4.9 |
| 500 | 6.0 | 4.8 | 7.8 | 4.4 | 9.3 | 4.5 | 11.1 | 4.0 |
| 550 | 5.8 | 4.9 | 7.8 | 4.4 | 9.3 | 4.5 | 11.4 | 4.0 |
| 600 | 5.8 | 4.7 | 7.8 | 4.7 | 9.3 | 4.7 | 11.4 | 4.8 |

The distance in Table 2 is the distance measured from the tip portion of the aluminum alloy member.

EXAMPLE 2

Similar coating processes were made as in the Example 1 except that the workpieces were first dipped into the coating bath for thirty minutes and moved upwardly with the lifting speed of 1.2 m/min. to the position that the upper ends of the workpieces are positioned 15 cm above the bath surface, then again dipped into the coating bath and immediately taken out of the bath with the lifting speed of 1.2 m/min.

Table 3 shows the results of this process and the results of the process of Example 1 in which the workpieces were suspended vertically.

Table 3

| Type of process / Lifting speed / Distance | Vertically suspended workpiece | |
|---|---|---|
| | Example 1<br>1.2 m/min | Example 2<br>1.2 m/min |
| 5 | 6.7μ | 9.7μ |
| 10 | 8.1 | 12.0 |

Table 3-continued

| Type of process / Lifting speed / Distance | Vertically suspended workpiece | |
|---|---|---|
| | Example 1<br>1.2 m/min | Example 2<br>1.2 m/min |
| 15 | 10.0 | 13.4 |
| 20 | 11.4 | 14.9 |
| 30 | 11.8 | 15.3 |
| 40 | 11.3 | 15.8 |
| 50 | 11.4 | 15.3 |
| 80 | 11.8 | 13.6 |
| 100 | 11.4 | 12.2 |
| 150 | 11.5 | 12.0 |
| 200 | 11.4 | 12.0 |
| 250 | 11.1 | 12.1 |
| 300 | 11.1 | 12.0 |
| 350 | 11.5 | 12.3 |
| 400 | 11.4 | 12.2 |
| 450 | 11.0 | 12.1 |
| 500 | 11.1 | 12.2 |
| 550 | 11.4 | 12.1 |
| 600 | 11.4 | 12.0 |

EXAMPLE 3

Similar workpieces as in Example 1 were degreased by dipping them for one minutes into 70°C, 5% solution of emulsion type neutralized cleaning agent, then washed by water of room temperature, etched by dipping them for three minutes into 80°C, 5% solution of NaOH, again washed by water of room temperature, dipped into 10% room temperature solution of $HNO_3$ two minutes to neutralize, and thereafter washed. The workpieces thus pretreated were subjected to anodising process.

15% solution of $H_2SO_4$ was used as the electrolyte and the anodising process was performed for thirty minutes under the bath temperature of 20°C, 16 Volts of DC power source and 13 A/cm² of current density. After the anodising process, the workpieces ware washed by water of room temperature and kept wet. The workpieces were then subjected to dip coating process so as to form coatings thereon with the following specification.

| | |
|---|---|
| (a) Composition of Coating Material (80% dillution by water) | |
| Acryl resin | 13.3% |
| Melamine resin | 6.1% |

-continued

| | |
|---|---|
| IPA | 22.1% |
| ethylen-glycol-mono-ethyl-ther | 3.4% |
| water and others | 55.1% |
| (i) specific weight | 0.985 |
| (ii) surface tension | 34 dyne/cm |
| (iii) viscosity | 19 cps |
| (iv) temperature | 25°C |
| (b) Process Specification | |
| (i) lifting speed | 0.4, 0.7, 1.0, 1.4 m/min. |
| (ii) Baking | 40°C, 10 minutes to 180°C, 30 minutes |

Figure 15:
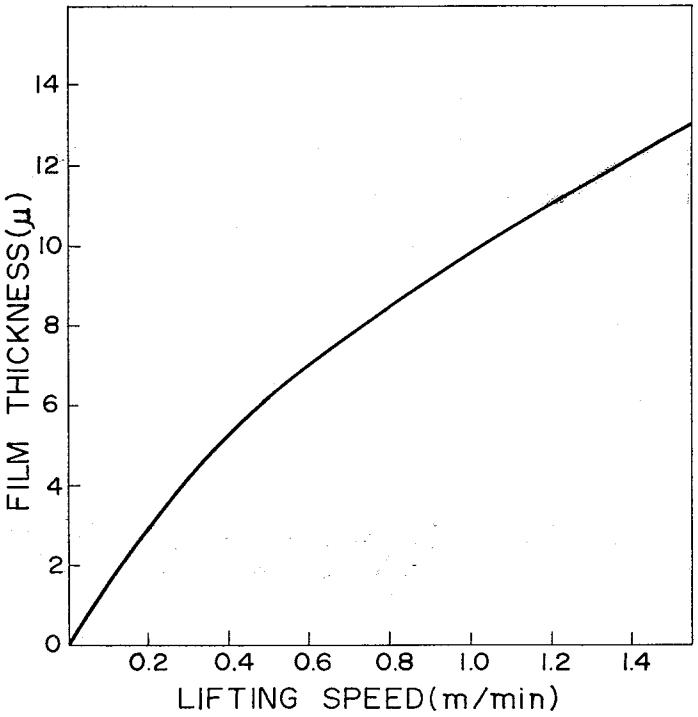

The relationship between the lifting speed and the coating as obtained by this example is shown in FIG. 15.

EXAMPLE 4

Aluminum alloy members similar to those in Example 1 were similarly degreased and formed with boehmate coatings thereon. Thereafter, the members were vertically suspended and dipped into a coating bath of the following specification to form brown coloured coatings thereon.

| | | |
|---|---|---|
| (a) Composition of Coating Material (60% dillution by water) | | |
| ferric hydroxide | 3.3% | |
| carbon black | 1.3% | |
| | | pigments |
| Indian red | 3.3% | |
| titanate | 4.6% | |
| acryl resin | 17.3% | |
| malamine resin | 2.9% | |
| butyrin-glycol-mono-ethyl-ether | 23.4% | |
| ethylene-glycol-mono-ethyl-ether | 4.7% | |
| water and others | 39.2% | |
| (i) specific weight | 1.079 | |
| (ii) surface tension | 34 dyne/cm | |
| (iii) viscosity | 31.5 cps | |
| (iv) temperature of coating material | 40°C | |
| (b) Process Specification | | |
| (i) dipping time | 20 sec | |
| (ii) lifting speed | 0.4, 0.7, 1.0, 1.5 m/min. | |
| (iii) baking | 40°C, 10 minutes to 180°C, 30 minutes | |

Figure 16:
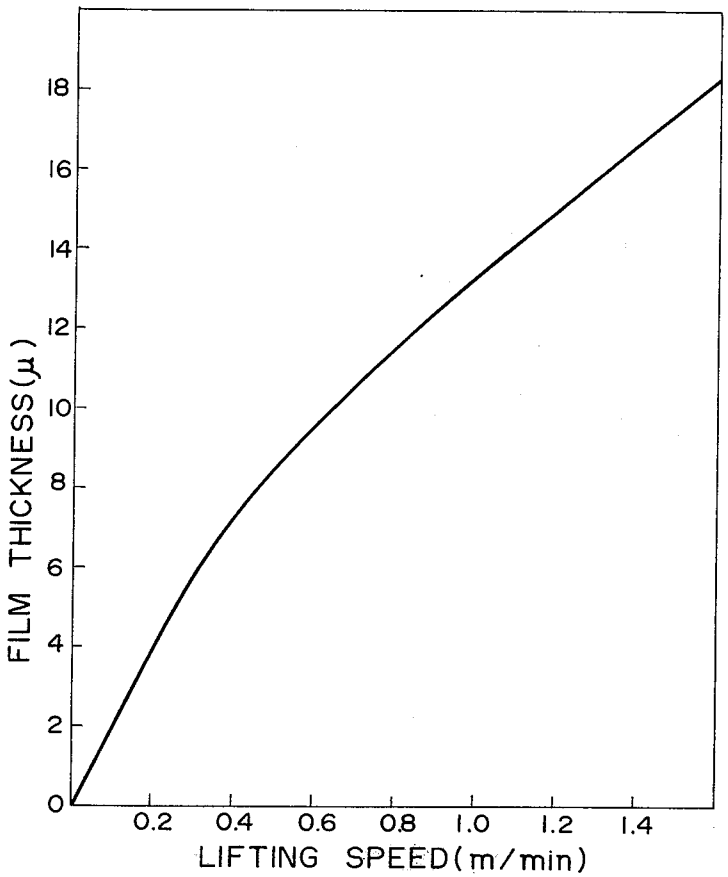

The relationship between the lifting speed of the members and the coating thickness in this example is shown in FIG. 16.

EXAMPLE 5

Aluminum alloy members similar to those in Example 1 were degreased and subjected to anodising process to form oxidized coatings thereon as in the Example 3. Thereafter, the members were suspended vertically and dipped into a bath of the following specification to form white colured coatings thereon. It has been assured that the coatings were satisfactorily uniform.

| | |
|---|---|
| (a) Composition of Coating Material (80% diluted by water) | |
| titanate (pigment) | 22.2% |
| acryl resin | 11,1% |
| malamine resin | 2.8% |
| IPA | 11.7% |
| ethylen-glycol-mono-ethyl-ether | 3.9% |
| water and others | 48.3% |
| (i) specific weight | 1.200 |
| (ii) surface tension | 35.2 dyne/cm |
| (iii) viscosity | 35 cps |
| (iv) temperature of the coating material | 24°C |
| (b) Process Specification | |
| (i) dipping time | 15 sec |
| (ii) lifting speed | 0.4, 0.7, 1.0, 1.5 m/min. |
| (iii) baking | 40°C, 10 minutes to 180°C, 30 minutes |

Figure 17:
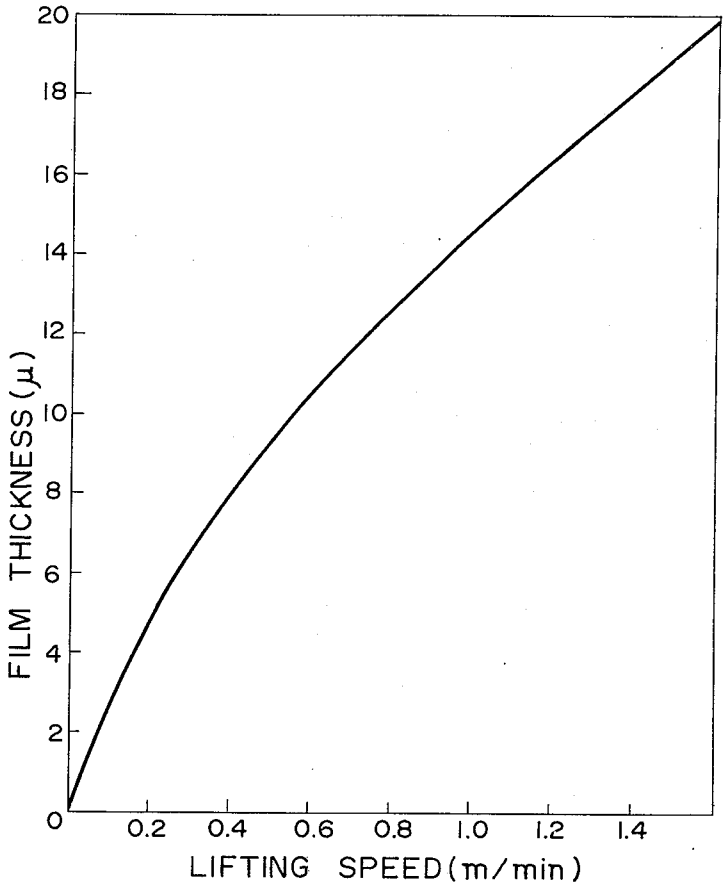

The relationship between the lifting speed and the coating thickness is shown in FIG. 17.

Baking is performed when the coated workpieces are transported from the coating bath 9 to the baking vessel 10. The workpieces are transported into the baking vessel 10 as in the transportation into the baths. The workpieces are then transported out of the heated chamber 11 by the horizontal conveying means 13 into the horizontal conveying means 15. The carrier bar 3 having finished workpieces suspended therefrom is then transferred to the third lifting means 16 by which the carrier bar 3 is moved downwardly to the position where it is received by the grooves 24 in the unloading frame 17. The frame 17 is then rotated to the horizontal position where the workpieces are released from the carrier bar 3 by actuating the levers 49 of the suspending devices 45. The released workpieces are moved by the discharge conveyor 25 toward a further transport conveyor (not shown). The empty carrier bar 3 on the unloading frame 17 is returned to the third lifting device 16 by rotating the frame 17 to the vertical position and conveyed upwardly to the return conveyor 18. The return conveyor 18 receives the empty carrier bar 3 and conveys it toward the first lifting means 6. Then, the empty carrier bar 3 is transferred to the first lifting means 6 and returned thereby to the loading frame 4.

According to the present invention, each chain conveyor 60 on each conveying means can be separately actuated so that it is possible to control the movements of the carrier bars independently from each other. Thus, it is possible to keep one carrier bar waiting when a further carrier bar is still in the next working station. Further, when desirable, a succeeding carrier bar may be passed over a vessel or bath in which a preceding carrier bar is inserted into a next vessel or bath, by using an upper by-pass crane. It is also possible to control the speed of the lifting and conveying means as desired.

Although the invention has been shown and described with reference to a preferred embodiment, it should be noted that the invention is in no way limited to the details of the illustrated structures but changes and modifications may be made without departing from the scope of the appended claims.

We claim:

1. Apparatus for surface-treating a plurality of workpieces simultaneously comprising:

a. at least one means at a given position for treating the workpieces;

b. a detached carrier bar having devices for receiving and vertically suspending the plurality of the workpieces in side-by-side relationship;

c. loading means having frame means for receiving and releasing said carrier bar and for rotating between horizontal and vertical positions while retaining said carrier bar horizontally and broadside;

d. first lifting means for receiving said carrier bar when loaded with the workpieces from said loading means in its vertical position and for returning said carrier bar when unloaded to said loading means, said lifting means being vertically movable between lower and higher positions with said carrier bar retained horizontally thereon by its ends;

e. conveyor means for receiving said loaded carrier bar from said first lifting means at said higher position and for conveying said carrier bar by its ends horizontally and broadside;

f. second lifting means positioned above said treating means and interacting with said conveyor means for vertically moving said carrier bar in a horizontal position with said plurality of workpieces suspended therefrom downwardly into and upwardly from said treating means and back substantially to the level of said higher position;

g. unloading means having frame means for receiving and releasing said carrier bar and for rotating between vertical and horizontal positions while retaining said carrier bar horizontal and broadside;

h. third lifting means for receiving said carrier bar when loaded with the workpieces from said conveyor means and lowering said carrier bar to said unloading means in its vertical position and for receiving said carrier bar when unloaded from said unloading means and raising said unloaded carrier bar vertically; and i. return conveyor means for receiving said unloaded carrier bar from said third lifting means and returning said unloaded carrier bar broadside to said first lifting means for lowering to said loading means in its vertical position.

2. The apparatus in accordance with claim 1, wherein said conveyor means comprises a plurality of discrete horizontal transfer devices.

3. The apparatus in accordance with claim 2, wherein said first, second, and third lifting means includes vertically extending stationary frame means, second frame means vertically movable along said stationary frame means, means for vertically moving said second frame means, and at least one said horizontal transfer device mounted on said second frame means for receiving and conveying said carrier bar, and means for actuating said horizontal transfer device.

4. The apparatus in accordance with claim 3, wherein said second lifting means includes two transfer devices, an upper vertically movable transfer device and a lower vertically movable transfer device, wherein said lower transfer device is moved downwardly by said second frame means with said carrier bar loaded with vertically suspended workpieces for treatment in said treating means, said upper transfer device being moved downwardly into position to receive and transfer another loaded carrier bar past said treating means.

5. The apparatus in accordance with claim 3, wherein said means for vertically moving said second frame means includes a chain with one end connected with said second frame means and the other end with a weight, a sprocket mounted on a top portion of said vertically extending stationary frame means for engaging and driving said chain, and means for rotating said sprocket, said chain thereby moving said second frame means.

6. The apparatus in accordance with claim 1, wherein said loading and unloading frame means includes grooved means at one end for receiving and retaining said carrier bar, said grooved means being positioned for conveying said carrier bar between said loading and unloading frame means, and said first and third lifting means, respectively, when said loading and unloading frame means are in the vertical position.

7. The apparatus in accordance with claim 1, wherein said return conveyor means comprises a plurality of conveyor assemblies, each of said conveyor assemblies having chain conveyor means and means for actuating said chain conveyor means for independently controlling the movement of said carrier bar on each of said conveyor assemblies.

8. The apparatus in accordance with claim 1, further including enclosure means defining a chamber above a part of said treating means, and wherein said second lifting means includes a further horizontal conveyor means for transferring said carrier bar loaded with vertically suspended workpieces around the lower portions of said enclosure means.

9. The apparatus in accordance with claim 1, wherein each of said suspending devices has a body with one portion engageable with said carrier bar and a second opened cut-out portion for receiving one end of the workpiece, a roller positioned in said cut-out portion for gripping the workpiece received in said cut-out portion, a lever means for rotatably supporting said roller and for moving said roller in said cut-out portion; and a spring for biasing said lever toward a position for forcing said roller toward the opening of said cut-out portion and against the workpiece.

10. The apparatus in accordance with claim 9, wherein said suspending devices are made of an electrically conductive material, and wherein said carrier bar has an electrically conductive portion in contact with said suspending devices.

11. The apparatus in accordance with claim 1, wherein said loading frame has conveyor means mounted thereon for conveying the workpieces side-by-side onto said loading frame means in its horizontal position and wherein said unloading frame means has conveyor means mounted for conveying the workpieces side-by-side after release from said suspending devices off of said unloading frame means in its horizontal position.

12. The apparatus in accordance with claim 11, further including inlet conveyor means adjacent said loading frame means for transferring workpieces side-by-side onto said conveyor means of said loading frame means when said loading frame means is in its horizontal position.

* * * * *